US008640865B2

(12) United States Patent
Smart

(10) Patent No.: US 8,640,865 B2
(45) Date of Patent: Feb. 4, 2014

(54) CAP FOR STORING MATERIALS SEPARATE FROM A BODY OF LIQUID AND FACILITATING SUBSEQUENT MIXING OF THE MATERIALS AND THE LIQUID

(76) Inventor: William Smart, Littleton, CO (US)

( * ) Notice: Subject to any disclaimer, the term of this patent is extended or adjusted under 35 U.S.C. 154(b) by 31 days.

(21) Appl. No.: 13/461,157

(22) Filed: May 1, 2012

(65) Prior Publication Data

US 2013/0292275 A1 Nov. 7, 2013

(51) Int. Cl.
*B65D 25/08* (2006.01)
*B67D 1/00* (2006.01)
*B67D 7/74* (2010.01)

(52) U.S. Cl.
USPC ..... 206/219; 222/83; 222/129; 215/DIG. 8

(58) Field of Classification Search
USPC ..... 206/219–222; 215/6, 10, DIG. 8; 222/80–83, 129, 145.1–145.6, 222/522–525
See application file for complete search history.

(56) References Cited

U.S. PATENT DOCUMENTS 3,441,179 A * 4/1969 Ragan ..... 222/129
3,651,990 A * 3/1972 Cernei ..... 222/129
5,060,791 A * 10/1991 Zulauf ..... 206/221
6,540,070 B1 * 4/2003 Conwell ..... 206/219
6,854,595 B2 2/2005 Kiser
6,959,839 B2 * 11/2005 Roth et al. ..... 222/83
7,306,117 B2 * 12/2007 Roth et al. ..... 222/83
7,909,210 B2 * 3/2011 Roth et al. ..... 222/83
8,011,534 B2 * 9/2011 Roth et al. ..... 222/83
8,083,055 B2 * 12/2011 Simonian et al. ..... 206/221
8,276,748 B2 * 10/2012 Nyambi et al. ..... 206/222
8,443,969 B2 * 5/2013 Nyambi et al. ..... 206/222
2005/0139622 A1 6/2005 Saulle
2007/0023300 A1 2/2007 Spector et al.
2008/0093381 A1 4/2008 Smith et al.
2008/0099487 A1 5/2008 Winn
2009/0139882 A1 * 6/2009 DeJonge ..... 206/219
2009/0139951 A1 6/2009 Chen
2009/0308831 A1 12/2009 Anderson
2011/0024454 A1 * 2/2011 Dyrbye et al. ..... 222/129
2011/0174642 A1 7/2011 Coon
2011/0192735 A1 8/2011 Cronin et al.
2011/0259769 A1 10/2011 Salinas

FOREIGN PATENT DOCUMENTS

WO 2010084176 7/2010
WO 2011147278 12/2011

* cited by examiner

*Primary Examiner* — Bryon Gehman
(74) *Attorney, Agent, or Firm* — Marsh Fischmann & Breyfogle LLP; Jonathon A. Szumny

(57) ABSTRACT

A closure attachable over the opening of a container that selectively facilitates mixing of a component (e.g., supplement, vitamins, etc.) of any appropriate form (e.g., powders, flakes, liquids) with a liquid in the container to create a mixture. In one aspect, the closure includes a body, a storage compartment within the body, a nozzle movably received on the annular wall, a cap receivable over a portion of the body and the nozzle, an annular pull strip surrounding the body and spacing the first end of the cap from an outer collar of the body, and a plunger disposed within the storage compartment that is adapted to selectively break a seal to allow for mixing between the component and the liquid.

17 Claims, 15 Drawing Sheets

CAP FOR STORING MATERIALS SEPARATE FROM A BODY OF LIQUID AND FACILITATING SUBSEQUENT MIXING OF THE MATERIALS AND THE LIQUID

FIELD OF THE INVENTION

This invention generally relates to container closures or caps for beverage containers and, more particularly, to a container closure including an internal storage compartment for holding a mixture or blend of any appropriate nutrient or supplement along with an actuation device that selectively breaks a seal of the storage compartment to allow for mixing of the beverage and the contents of the storage compartment.

BACKGROUND OF THE INVENTION

Many different styles of caps, lids and closures for liquid and beverage containers are available and serve numerous purposes. For instance, many containers include some sort of tamper proof closure over or adjacent the container opening such as a "milk jug" ring, a foil seal, and the like. As another example, some containers include a cap that seals the container using a check valve by taking advantage of the squeeze action of a flexible bottle to create a pressure differential to activate the valve.

More recently, container closures have been introduced that include at least one compartment within which a blend of one or more ingredients (e.g., vitamins, minerals, other supplements) can be sealed and maintained separately from the liquid or beverage within the container until a time at which a user desires to mix the blend and the liquid and consume the resulting mixture. Many of these devices include some sort of piercing tip or cutter that perforates, cuts or otherwise breaks a seal (e.g., foil, blister pack, membrane, etc.) to release the blend (e.g., tablets, granules, powders, etc.) into the liquid in the container. In some prior devices, the container closure is completely removed from the container after the blend has been mixed with the liquid in order to consume the mixture; in others, the container closure remains secured over the container opening and a nozzle on the container closure is selectively opened to allow for consumption of the resulting mixture.

SUMMARY OF THE INVENTION

Disclosed herein is a closure that is adapted to attach to a container over an opening of the container and selectively facilitate the efficient mixing of one or more components or ingredients (e.g., supplement, vitamins, etc.) of any appropriate form (e.g., powders, beads, flakes, liquids, crystals, effervescent, etc.) with a liquid contained within the container to create a mixture that may be consumed by an end user. In one aspect, the closure includes a body having an outer collar and an annular wall extending from the outer collar, where the annular wall surrounds a storage compartment; a nozzle (e.g., sipper) received on the annular wall and having an opening; a cover or cap receivable over a portion of the annular wall and the nozzle, the cap having first and second opposing ends; an annular pull strip surrounding the annular wall and spacing the first end of the cap from the outer collar; and a plunger disposed within the storage compartment. The plunger is generally prevented from moving towards the outer collar when the pull strip is spaced between the cap and the outer collar around the annular wall, and the plunger is allowed to move towards the outer collar (e.g., so as to break a seal secured to a lower portion of the storage compartment) when the pull strip is at least partially separated or removed from the annular wall and thereby allow for mixing between the ingredient(s) and the liquid in the container to create a mixture.

As an example, imagine a user purchases a beverage container (e.g., water bottle) with the disclosed container closure being secured (e.g., threaded) over the container opening and any appropriate ingredient(s) (e.g., antioxidants, vitamins, etc.) being contained within the storage compartment. For instance, the combined beverage container and container closure apparatus may includes at least two distinct and separate cavities or compartments separated by a seal, where one cavity is the interior of the container (which contains the liquid) and the other cavity is the storage compartment of the closure (which contains the ingredient(s)).

Once the user is ready to combine the component and the liquid and consume the resulting mixture, the user may initially pull and remove the pull strip or ring (that separates the cap from the outer collar) from the closure. Thereafter, the user may press downwardly on the cap to move the cap towards the outer collar and container to break the seal and allow the ingredient(s) to fall into or otherwise mix with the liquid in the container to create a mixture. For instance, the upper end of the plunger may extend through and protrude away from an opening in the nozzle and contact or at least be substantially adjacent an underside of the cap before the pull strip has been removed or at least before the cap has been pressed downwardly. In this regard, pressing downwardly on the cap induces a corresponding downward movement of the plunger (relative to the nozzle and body of the closure) which serves to break (e.g., pierce, rupture) the seal. That is, the nozzle may remain in a closed position and be static (relative to the plunger) while the plunger is moving downwardly to break the seal which limits the leakage of fluids or ingredients from the container or closure. In one arrangement, the closure may be designed so that the seal breaks upon an underside of the cap contacting the top of the nozzle. In another arrangement, the closure may be designed so that the seal breaks upon a bottom rim of the cap contacting the outer collar of the closure. The user may, if desired, shake the container to facilitate sufficient mixing of the component and the liquid. At this point, the upper end of the plunger may be generally level with (or only slightly protrude from) an upper surface of the nozzle.

The storage compartment of the container closure and the interior of the container now generally comprise a single cavity within which the mixture is generally free to reside and move. To consume the mixture, the user may first remove the protective cap from the closure (e.g., via grasping and lifting the cap away from the container to separate the cap from the closure). Thereafter, the user may lift the nozzle disposed over and around the annular wall (i.e., move the sipper in a direction away from the container) to expose a passageway in fluid communication with the single cavity and allow for consumption of the mixture via an opening in the nozzle.

In one arrangement, the plunger may be designed to be movable (e.g., slidable) only in a direction towards the interior of the container. That is, the plunger may be designed so that once it is pressed downwardly (e.g., via a user pressing the cap, via a user pressing the plunger directly with a finger or thumb) to break the seal, the plunger may be generally unable to move in an opposite direction away from the container interior. As an example, the plunger may have engagement elements such as openings or protrusions (e.g., ribs, bumps, etc.) in or on an outer surface thereof that are adapted to engage (e.g., mesh) with corresponding engagement elements in or on an interior surface of the annular wall or a stem or sleeve within the annular wall through which the plunger extends. For instance, once the cap has been pressed downwardly to induce a corresponding downward motion of the plunger to break the seal, the engagement elements of the plunger may engage with those of the annular wall or stem to prevent or at least limit the plunger from moving (e.g., sliding) back away from the container interior (e.g., when the nozzle is moved upwardly to consume the mixture). This arrangement may advantageously serve as an additional seal against the unintended exiting of fluids from the container as well as a safety mechanism to warn users about possible tampering with the contents of the closure or container.

Once the user has finished consuming the mixture, the user may press downwardly on the nozzle or sipper (e.g., in a direction towards the container) to reseal the storage compartment and prevent or at least limit any remaining mixture from leaking out of the closure via the storage compartment. If desired, the user may also press the cap back over the sipper and into contact with the annular wall and/or outer collar of the closure. Of course, the user may subsequently remove the cap (if necessary) and again pull or lift the nozzle away from the container to unseal the storage compartment and allow for consumption of the mixture.

Various refinements may exist of the features noted in relation to the various aspects. Further features may also be incorporated in the various aspects. These refinements and additional features may exist individually or in any combination, and various features of the aspects may be combined. In addition to the exemplary aspects and embodiments described above, further aspects and embodiments will become apparent by reference to the drawings and by study of the following descriptions.

DESCRIPTION OF THE DRAWINGS

For a more complete understanding of the present invention and further advantages thereof, reference is now made to the following Detailed Description, taken in conjunction with the drawings, in which:

FIG. 8 is an isometric view of a filling tray according to one embodiment that may be used during a processing of filling one or more of the container closures with one or more component or ingredients in the form of beads, flakes, and/or the like.

FIG. 9 is an isometric view of a filling tray according to another embodiment that may be used during a processing of filling one or more container closures with one or more component or ingredients in the form of beads, flakes, and/or the like.

DETAILED DESCRIPTION

Reference will now be made to the accompanying drawings, which assist in illustrating the various pertinent features of the various novel aspects of the present disclosure. In this regard, the following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

Figure 1:
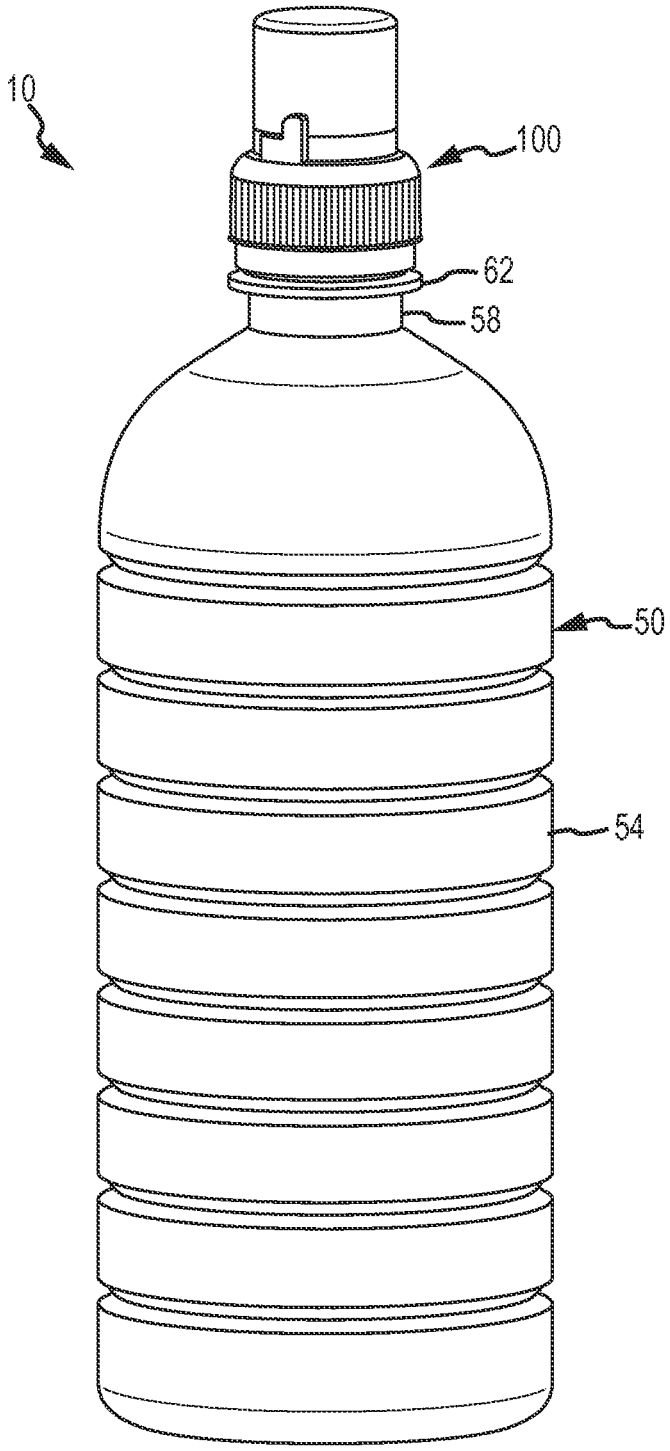
FIG. 1 is an isometric view of an apparatus including a container closure disclosed herein being secured over the opening of a container, according to one embodiment.

FIG. 1 is an isometric view of an apparatus 10 including a container 50 (e.g., bottle, jar) generally having a body 54 with an internal cavity or interior (not shown) that is adapted to contain a liquid therein, a neck 58, a collar 62, and a finish (not shown) having an opening (not shown) over which a container closure 100 formed of any appropriate materials (e.g., plastics, composites, etc.) may be secured. As will be discussed more fully herein, the container closure 100 includes an internal storage compartment (now shown in FIG. 1) for containing one or more components or ingredients (e.g., supplements, vitamins, effervescent, etc.) of any appropriate form (e.g., powders, flakes, beads, capsules, liquids, etc.) as well as structure for allowing a user to selectively mix the ingredients with liquid in the container 50 to create a mixture that may be consumed as desired.

While one type of container 50 is shown in FIG. 1, the disclosed closure 100 may be secured onto numerous types of containers 50 in various manners (e.g., threading, snap-fitting, plastic welding, etc.). Furthermore, while the closure 100 is shown as being secured onto the container 50 to form apparatus 10, the closure 100 may be disconnected and separate from the container 50 during numerous stages of one or more chains of distribution. In one arrangement, it is envisioned that closures 100 could be manufactured at one plant or facility, filled with ingredients at the same or a different facility, packaged and transported to a bottling facility that purchases the filled closures 100, secured onto liquid-filled bottles, packaged and transported to wholesalers and/or retailers who purchase the bottles with the filled caps thereon, and then eventually sold to end users. In another arrangement, it is envisioned that the closures 100 could be manufactured, sold to a filling facility for filling any desired ingredients, and then sold to wholesales or retails for eventual sale to end users (i.e., without a bottle). In a further arrangement, the un-filled closures 100 could be sold to users as kits with seals so that a user could fill the storage compartment with one or more desired ingredients, seal the storage compartment, and then secure the closures 100 onto bottles.

Figure 2:
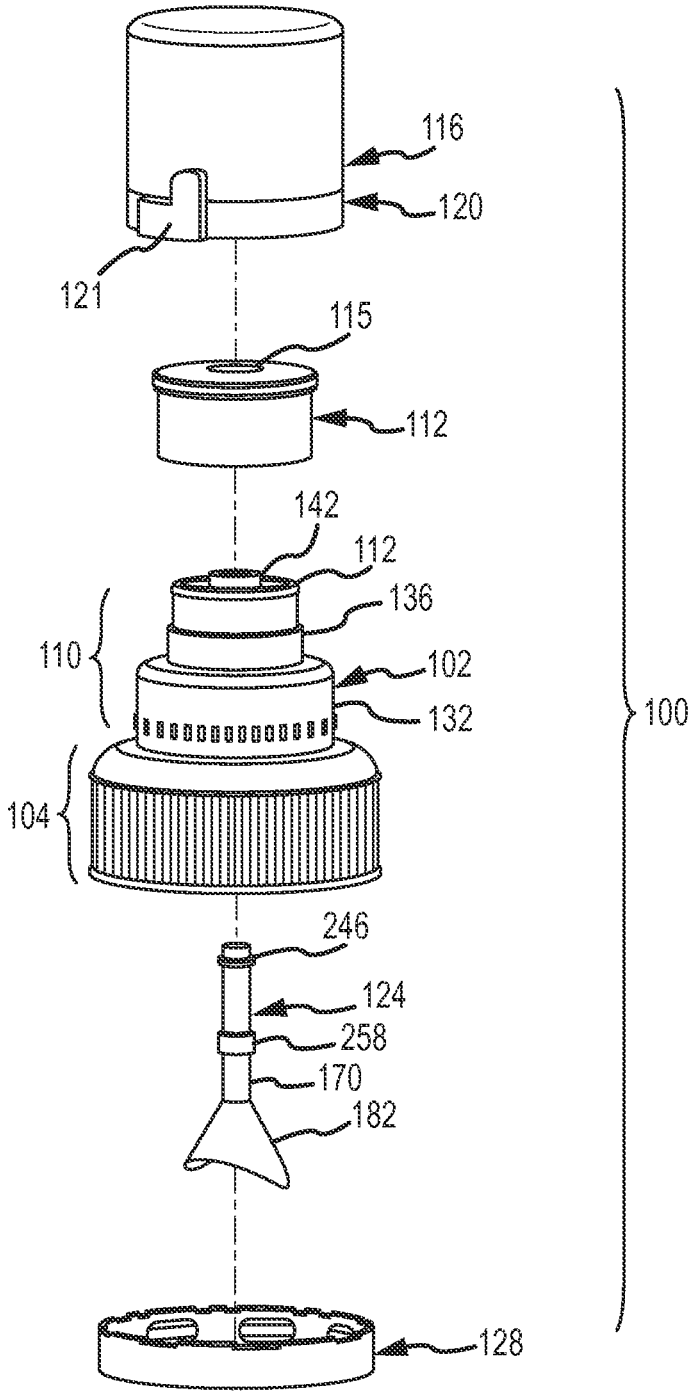
FIG. 2 is an exploded isometric view of the container closure of FIG. 1.
Figure 3:
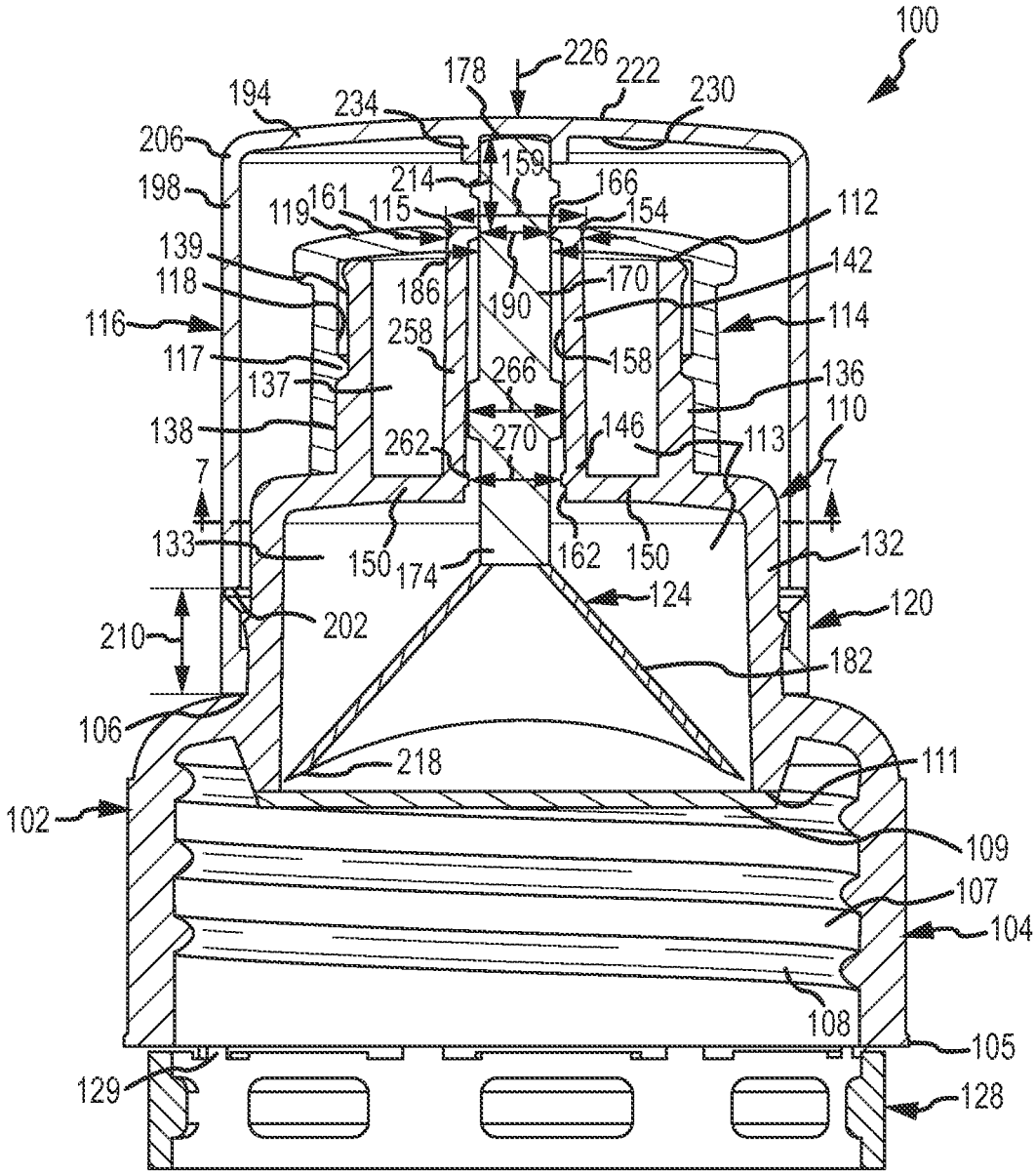
FIG. 3 is a sectional view of the container closure of FIG. 1 before a pull strip of the container closure has been removed.

Turning now to FIGS. 2-3, an exploded isometric view and a sectional view of the closure 100 before activation are respectively illustrated. The closure 100 generally includes a body 102 made up of an outer collar 104 and an annular wall 110 connected to (e.g., either as a one-piece structure or appropriately secured to, such as via plastic welding) and extending away from the outer collar 104, a nozzle 114 (e.g., sipper) movably (e.g., slidably) received over and along an outer surface of the annular wall 110, a protective cap 116 receivable over the nozzle 114 and a portion of the outer surface of the annular wall 110, a removable seal such as a protective pull strip 120 disposable about a portion of the annular wall 110 and adapted to space the cap 116 from the outer collar 104 so as to prevent or at least limit downward movement of the cap 116 towards the outer collar 104, and at least one plunger 124 disposed within a storage compartment 113 that is within or otherwise surrounded by the annular wall 110.

The outer collar 104 has first and second opposing ends 105, 106 along with a hollow interior 107 (shown in FIG. 3) between the first and second ends 105, 106 which is adapted to receive and engage with an outer surface of the finish of the container 50. For instance, an inner wall of the outer collar 104 may include threads 108 (e.g., of any appropriate pitch, lead, etc.) that are adapted to engage with corresponding threads on the finish of the container 50. In one arrangement, the body 102 may have a safety ring 128 secured to the first end 105 of the outer collar 104 (e.g., via frangible posts 129) and that is adapted to be secured around the finish of the container 50 (e.g., as in FIG. 1). In the event that a user wanted to remove the closure 100 from the container 50, the user could grasp and twist the outer collar 104 (e.g., in a counter-clockwise direction) with enough force to break the frangible posts 129 to allow the body 102 to be threaded off of or otherwise removed from the finish of the container 50.

Figure 7:
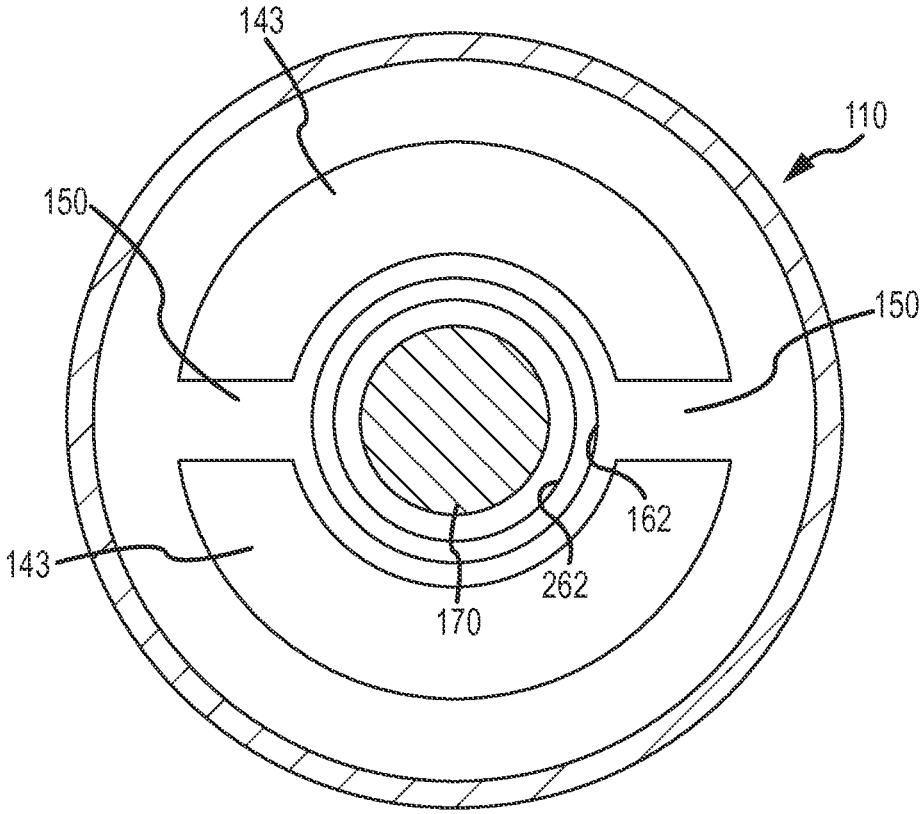
FIG. 7 is a sectional view through the line 7-7 of FIG. 3.

The annular wall 110 includes a first end 111 and an opposed second end 112 spaced from the outer collar 104, where a portion of the annular wall 110 may be attached or connected to the second end 106 of the outer collar 104. The storage compartment 113 generally extends between the first and second ends 111, 112 of the annular wall 110 and is adapted to store and contain a component (e.g., one or more ingredients) as will be discussed in more detail below. In one arrangement, and as shown, the annular wall 110 may include a lower portion 132 having a first diameter and an upper portion 136 having a second diameter different (e.g., smaller) than the first diameter. The upper and lower portions 132, 136 include respective sub-compartments 133, 137 that are fluidly interconnected (e.g., via one or more passageways 143 see FIG. 7) and that collectively make up the storage compartment 113.

After the storage compartment 113 has been at least partially filled with one or more ingredients in any appropriate manner (e.g., such as via the filling method discussed later on in this discussion), any appropriate seal 109 (e.g., made of foil, composites, etc.) may be adhered or otherwise secured to the first end 111 of the annular wall 110 to maintain the one or more ingredients separate from any liquid in the interior of the container 50 until a user desires to mix the component and the liquid (at which point the seal 109 may be broken by the plunger 124 as discussed more fully below). In one arrangement, the first end 111 of the annular wall 110 may extend below the second end 106 at least partially within the interior cavity 107 of the outer collar 104 (e.g., as shown in FIGS. 2-5) to facilitate the application of a seal 109 to the first end 111, to center the closure 100 over the opening of the container 50 and to provide for a more secure and robust connection between the finish of a container and the closure 100 (e.g., where the finish would be received between the outer collar 104 and the annular wall 110). In other arrangements, the first end 111 may end just at the second end 106 of the outer collar 104. Extending within at least a portion of the sub-compartment 133 of the upper portion 136 is a hollow sleeve or stem 142 having a first end 146 interconnected to the annular wall 110 (e.g., such as via a plurality of ribs 150, where the ribs 150 have the passageways 143 therebetween to allow for the fluid connection between the sub-compartments 133, 137, see FIG. 7) an opposing second end 154, and an interior cavity 158 extending between the first and second ends 148, 154. The first end 146 of the stem 142 includes a first aperture 162 leading into the sub-compartment 133 of the first portion 132, and the second end 154 includes a second aperture 166. The first aperture 162, second aperture 166 and interior cavity 158 are sized and shaped to slidably receive a shaft 170 of the plunger 124 as will be discussed in more detail below.

Before discussing the plunger 124 and its interaction with other parts of the closure 100, reference will now be made to the nozzle 114. As shown, the nozzle 114 may be movably received over an outer surface 138 of the upper portion 136 of the annular wall 110 and includes at least one aperture 115 having a diameter 159 that is substantially the same as (e.g., slightly larger than) an outer diameter 161 of the stem 142. In this regard, the nozzle 114 may be movable between at least a closed position (as in FIG. 3) whereby the stem 142 is received in the aperture 115 to create a seal that prevents or limits fluid flow out of the storage compartment 113 and an open position (as in FIG. 5, discussed in more detail later in this discussion) whereby the aperture 115 is moved away from the stem 142 and fluid can flow out of the storage compartment 113 via the aperture 115. In one arrangement, the second end 154 of the stem 142 may protrude at least partially past the second end 112 of the annular wall 110 to allow the stem 142 to be received in the aperture 115 of the nozzle. In another arrangement, the second end 154 of the stem 142 may be generally level with or even below the second end 112 of the annular wall 110. In the latter case, a top wall 119 of the nozzle 114 (which contains the aperture 115) may be at least partially angled downwardly to allow the stem 142 to still be received in the aperture 115 in the closed position of the nozzle 114.

For instance, the nozzle 114 may include an engagement member such as a rib 117 on an inner surface 118 of the nozzle 114 that is adapted to slidingly engage with a corresponding engagement member such as a depression or groove 139 on the outer surface 138 of the upper portion 136 of the annular wall 110. In this regard, the rib 117 and groove 139 allow the nozzle 114 to slide between the closed position (as in FIG. 3) and the open position (as in FIG. 5). Of course, other arrangements are envisioned such as corresponding threads on the inner surface 118 of the nozzle 114 and the outer surface 138 of the upper portion 136 (so that the nozzle 114 may be twisted to move the nozzle 114 to the open position) and the like.

With continued reference to FIGS. 2-3, the plunger 124 is broadly operable to be selectively actuated to pierce, rupture or otherwise break the seal 109 to allow for one or more ingredients (not shown) contained within the storage compartment 113 to fall into or otherwise mix with liquid in the container 50. The plunger 124 generally includes a shaft 170 that is slidably received in the interior cavity 158 of the stem 142 and having opposed first and second ends 174, 178. The plunger 124 also includes at least one rupture member 182 connected to the first end 174 of the shaft 170 and disposed at least initially in the sub-compartment 133 of the first portion 132 of the annular wall 110 that is adapted to rupture or otherwise break the seal 109 to allow for fluid communication between the storage compartment 113, the interior cavity 107 of the outer collar 104 and the interior of the container 50.

In one arrangement, the rupture member 182 may be in the form of a somewhat conical member with the narrowest portion of the member connected to the first end 174 of the shaft 170 and the widest portion of the member being spaced from the first end 174 of the shaft 170 so that the widest portion is the first portion of the rupture member 182 to contact and break the seal 109. This arrangement advantageously allows for a relatively large portion of the seal 109 to be broken to facilitate mixing of the components/ingredients and the liquid in the container 50 while limiting the degree to which pieces of the seal 109 break off and fall into the resulting mixture.

As shown, the shaft 170 has an outer diameter 186 that is substantially the same as (e.g., slightly smaller than) a diameter 190 of the second aperture 166 of the stem 142. This arrangement allows the shaft 170 to slide within and relative to the stem 142 while maintaining a substantial seal at the interface between the shaft 170 and the second end 154 of the stem 142 to prevent or at least limit fluids and ingredients from exiting the closure 100 via the second aperture 166 of the stem 142. Furthermore, the plunger 124 may be designed or manufactured as a substantially rigid, integral member so that movement of one portion of the plunger 124 induces a corresponding movement of another portion of the plunger 124. For instance, exerting a downward force on the second end 178 of the shaft 170 sufficient to move the second end 178 a distance x induces a corresponding movement of the rupture member 182 the distance x.

Before discussing additional features of the plunger 124 in addition to how the plunger functions to rupture the seal 109, reference is now made to the cap 116. As shown, the cap 116 may be receivable over the nozzle 114 as well as a portion of the annular wall 110. The cap 116 may include a top wall 194 as well as an annular sidewall 198 having a first end 202 spaced from the top wall 194 and an opposed second end 206 connected to the top wall 194. The annular sidewall 198 includes an inner diameter (not labeled) that is substantially the same as (e.g., slightly larger than) an outer diameter (not labeled) of the lower portion 132 of the annular wall 110 so that the cap 116 can be received over the lower portion 132.

As mentioned previously, pull strip 120 may be disposed between the first end 202 of the cap 116 and the second end 106 of the outer collar 104 and is generally operable to prevent downward movement of the cap 116 (i.e., in a direction towards the outer collar 104) until the pull strip 120 is removed. For instance, the pull strip 120 may include a pull tab 121 (see FIG. 2) which may be grasped by a user to unwrap the pull strip 120 from the closure 120. In one arrangement, the pull strip 120 may be integral with the cap 116 and a score line (not labeled) may be disposed between the cap 116 and pull strip 120 to facilitate removal of the pull strip 120 from the cap 116 and annular wall 110.

As mentioned previously, FIG. 3 presents a view of the closure 100 before the closure 100 has been "activated." That is, FIG. 3 illustrates the closure 100 before the pull strip 120 has been removed from the annular wall 110 and before the cap 116 has been pressed downwardly to induce a corresponding movement of the plunger 124 so as to rupture the seal 109 and mix the ingredients and the liquid in the container (not shown in FIG. 3). Before discussing operation of the closure 100, a number of observations will now be made with respect to the closure 100 in the non-activated position. First, the first end 202 of the cap 116 is generally spaced a distance 210 from the second end 106 of the outer collar 104 via the pull strip 120. As mentioned above, the pull strip 120 prevents or at least limits movement of the cap 116 towards the outer collar 104 (i.e., until the pull strip 120 is removed from the annular wall 110). Second, the second end 178 of the shaft 170 of the plunger 124 protrudes out of the second aperture 166 of the stem 142 and is spaced a distance 214 from the second end 154 of the stem 142. Third, a free end 218 of the rupture member 182 has yet to break the seal 109 (i.e., because the rupture member 182 is spaced from the seal 109 as shown in FIG. 3 or is in gentle contact with the seal 109).

To activate the closure 100, the pull strip 120 may first be removed from the annular wall (e.g., via grasping and pulling pull tab 121). Thereafter, an outer surface 222 of the top wall 194 of the cap 116 may be depressed in a downward direction 226 towards the outer collar 104 to rupture the seal 109 and allow for mixing between the ingredients and the liquid in the container. See FIG. 4. Turning briefly back to FIG. 3, an inner surface 230 of the top wall 194 of the cap 116 may be operable to contact the second end 178 of the shaft 170 of the plunger 124 upon depressing the outer surface 222 and allow for a direct transfer of force from the cap 116 to the plunger 124. In one arrangement, the inner surface 230 of the top wall 194 may include a centering member 234 (e.g., rib or protrusion extending away from the inner surface 230, a depression in the inner surface 230, etc.) into which the second end 178 of the shaft 170 may be received to facilitate the force transfer. In any event, use of the cap 116 advantageously spreads out the area over which a force can be applied (i.e., over the outer surface 222 of the top wall 194) to cause a corresponding downward movement of the plunger 124 (and in other words facilitates downward movement of the plunger 124 to rupture the seal 109).

Figure 4:
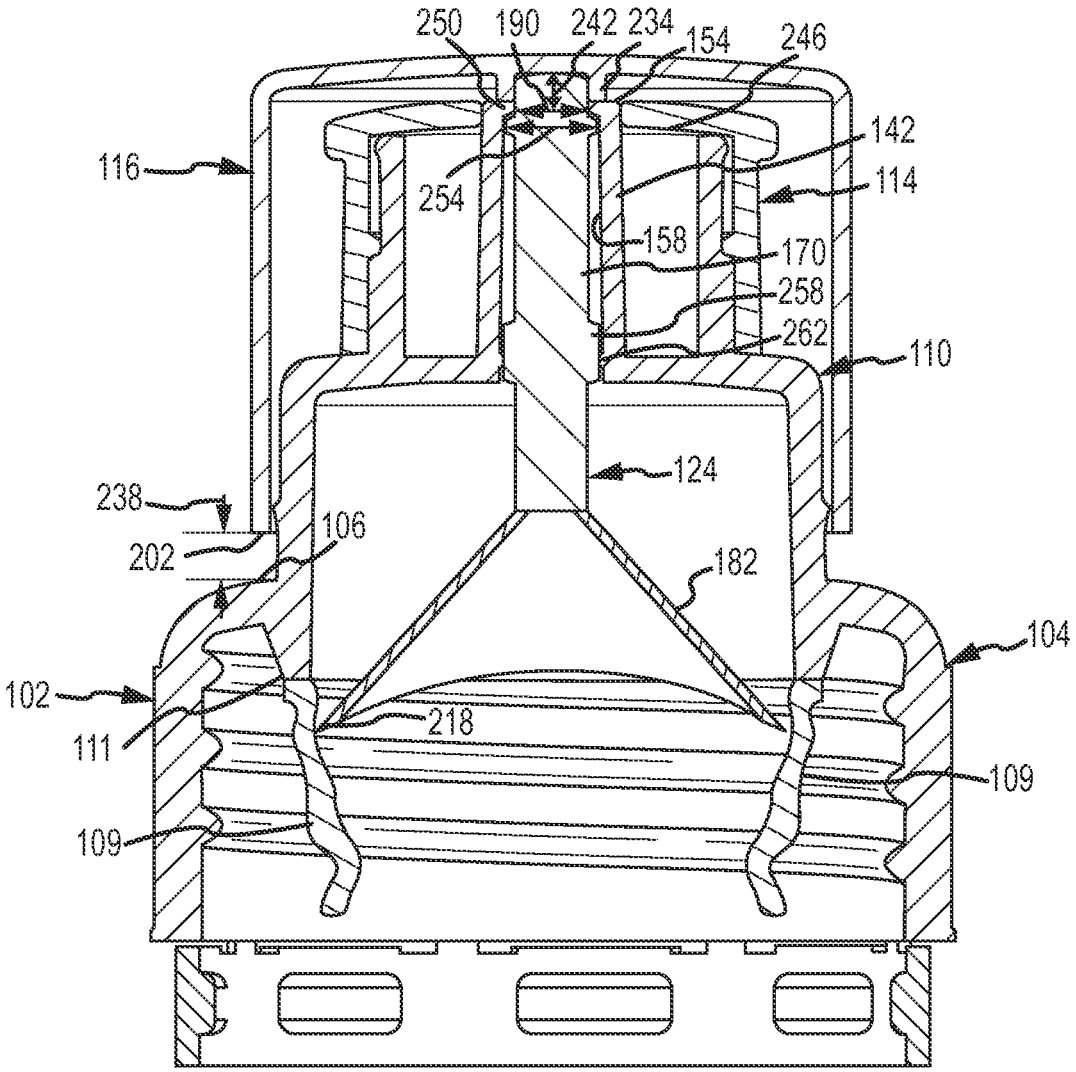
FIG. 4 is a sectional view similar to FIG. 3, but after the pull strip has been removed and a cap of the closure has been pressed downwardly to cause a plunger to puncture or break a seal of the closure.

Turning now to FIG. 4, a number of additional observations will now be made after the seal 109 has been ruptured by the rupture member 182. First, the first end 202 of the cap 116 is now spaced a distance 238 from the second end 106 of the outer collar 104 which is less than the distance 210 (see FIG. 3), and the second end 178 of the shaft 170 of the plunger 124 is now spaced a distance 242 from the second end 154 of the stem 142 which is less than the distance 214 (see FIG. 3). Furthermore, the difference between the distance 210 and the distance 238 is the same as the difference between the distance 214 and 242. In this regard, it can be seen how the downward force applied to the cap 116 to cause the cap 116 to move a distance is directly applied to the plunger 124 to cause the plunger to move the same distance.

As shown in FIG. 4, the distance is sufficient to cause the rupture element 182 to rupture the seal 109 to allow for mixing between the ingredients (not shown) in the storage compartment 113 and the liquid in the container 50. In one arrangement, the closure 100 may be designed so that the rupture member 182 sufficiently ruptures the seal 109 (i.e., to allow for mixing between the ingredients and the liquid) upon the lower surface 230 of the top wall 194 (e.g., the centering member 234) of the cap 116 contacting the nozzle 114 and/or second end 154 of the stem 142. Additionally or alternatively, the closure 100 may be designed so that the rupture member 182 sufficiently ruptures the seal 109 upon the first end 202 of the cap 116 making contact with the second end 106 of the outer collar 104. In either regard, a user may simply depress the cap 116 until the cap 116 can generally no longer be moved downwardly towards the outer collar 104, at which point the user can surmise that the seal 109 has been ruptured.

At this point, the interior of the container 50 and the storage compartment 113 of the closure 100 essentially form a single, fluidly interconnected cavity in which the mixture may freely occupy (i.e., from the interior of the container 50 through the interior cavity 107 of the outer collar 104, the sub-compartment 133 and up into the sub-compartment 137.

With continued reference to FIG. 4, it is noted that although the seal 109 has been ruptured to allow for mixing between the ingredients and the liquid, the resulting mixture is not yet able to exit the closure 100 (e.g., so as to be consumed by the user). More specifically, as the nozzle 114 is still in the closed position whereby the stem 142 is received in the aperture 115, the nozzle 114 and stem 142 form a seal the prevents or limits escape of the mixture from the storage compartment 113. Also, the shaft 170 is received in the second aperture 166 at the second end 154 of the stem 142 in the manner discussed previously which creates a seal to prevent or limit any of the mixture which may have entered the interior cavity 158 of the stem 142 from exiting the closure 100.

Furthermore, the plunger 124 and the stem 142 have a number of corresponding engagement elements that cooperate to both prevent or limit upward movement of the plunger (i.e., in a direction away from the outer collar 104) after the seal 109 has been broken as well as further prevent or limit the mixture from entering the interior cavity 158 of the stem 142 and/or exiting the interior cavity 158 via the second aperture 166. In one arrangement, the shaft 170 of the plunger 124 may include an engagement element on an outer surface thereof such as a rib 246 that is adapted to engage with a corresponding engagement element such as a rim 250 adjacent the second end 154 of the stem 142 to both limit upward movement of the plunger 124 (i.e., opposite of direction 226 in FIG. 3) and further seal the second aperture 166. For instance, and with reference to FIGS. 3-4, the rib 246 may have an outer diameter 254 that is greater than the diameter 190 of the second aperture 166 such that the rib 246 may be required to snap, deflect or otherwise be forcibly urged past the rim 250 into the interior cavity 158 of the stem 142. In one arrangement, the rib 246 and rim 250 may have correspondingly beveled or angled surfaces that further facilitate movement of the rib 246 past the rim 250 into the interior cavity 158 but that further resist removal of the rib 246 from the cavity 158 and thus movement of the plunger 124 in the upward direction.

As also shown, the shaft 170 of the plunger 124 may include an engagement element such as a protrusion 258 that is adapted to engage with a corresponding engagement element such as a rib 262 adjacent the first end 154 of the stem 142 to both limit upward movement of the plunger 124 (i.e., opposite of direction 226 in FIG. 3) and further seal the interior cavity 158 of the stem 142 adjacent the first aperture 162. For instance, and with reference to FIGS. 3-4, the protrusion 258 may have an outer diameter 266 that is greater than an inner diameter 270 of the second aperture rib 262 such that the protrusion 258 may be required to be forcibly urged into engagement with the rib 262. As shown in FIG. 4, engagement of the protrusion 258 and rib 262 may create a seal that prevents or limits the mixture from entering the interior cavity 158 of the stem 142. While the various engagement elements have been disclosed in the form of corresponding ribs, rims and protrusions, other embodiments envision that the engagement elements could be of other forms such as openings, grooves, etc. that are configured to engage with protrusions, ribs, etc.

Figure 5:
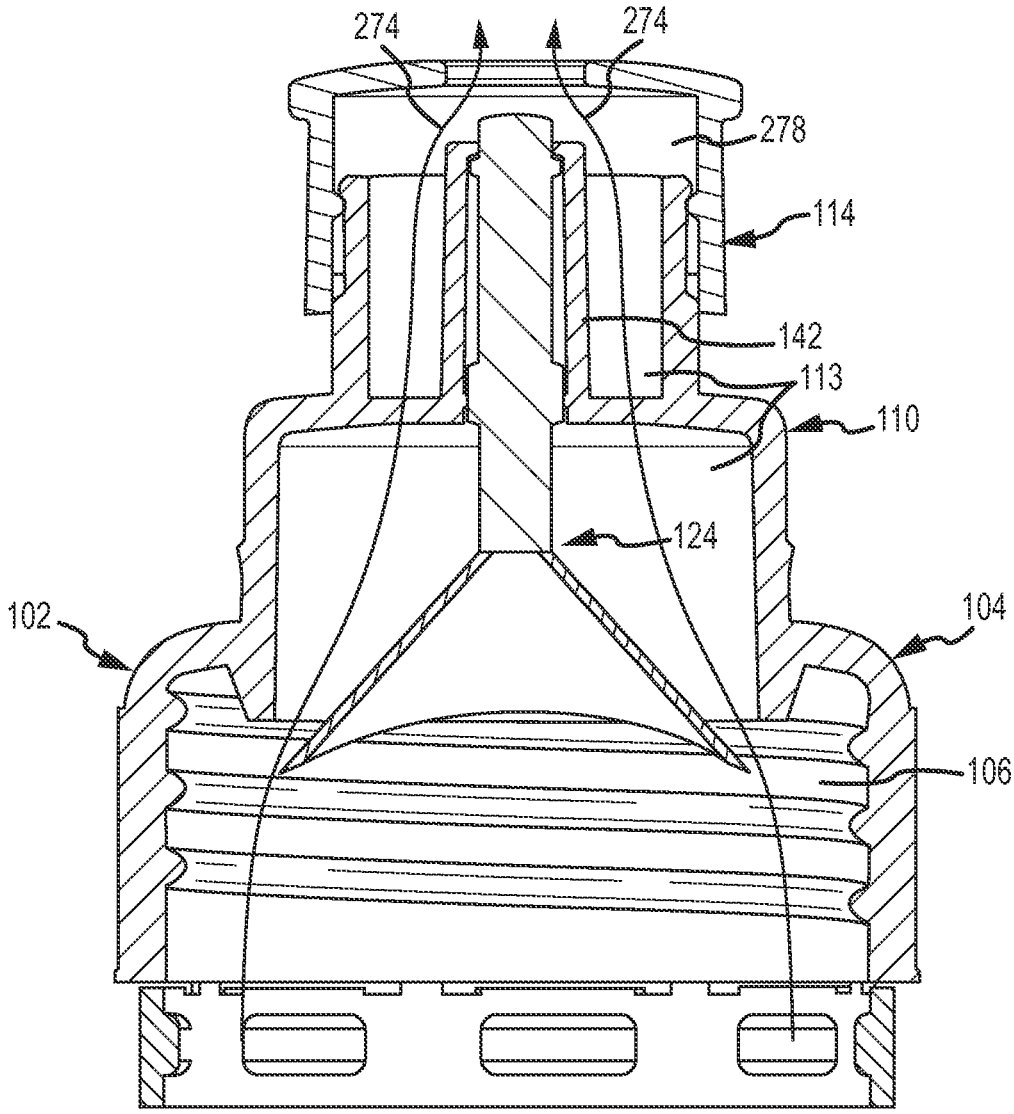
FIG. 5 is a sectional view similar to FIG. 4, but after a nozzle of the closure has been lifted upwardly to allow a user to consume a mixture within the apparatus.

Turning now to FIG. 5 (the seal 109 being removed for clarity), the closure 100 is illustrated in an open configured that allows a user to consume the mixture. To open the closure 100, the user may first remove the cap 116 and either dispose of the cap 116 or save the cap 116 to reapply over the nozzle 114 at a later time. Next, the user may grasp and lift the nozzle 114 upwardly in a direction away from the annular wall 110 or the outer collar 104 to move the aperture 115 of the nozzle 114 away from the stem 142 and allow for the mixture to exit the storage compartment 113 for consumption. Arrows 274 have been included in FIG. 5 to show various paths that the mixture may travel from the interior of the container 50 through the interior cavity 106 of the outer collar 104 and the storage compartment 113 and eventually out of the aperture 115 of the nozzle 114. It is noted that the nozzle 114 includes an interior cavity 278 that essentially forms part of the larger cavity (including the storage compartment 113, the interior cavity 107 of the outer collar 104 and the interior of the container 50 when the nozzle 114 is lifted into the position shown in FIG. 5.

As discussed above, the plunger 124 is designed to remain in the position shown in FIG. 4 even after the nozzle 114 has been lifted to allow for consumption of the mixture as shown in FIG. 5. This arrangement advantageously prevents or at least reduces the likelihood that the plunger 124 interferes with the user's consumption of the mixture, prevents or limits injury to the user via the plunger 124, maintains the aforementioned seals between the plunger 124 and the stem 142, and the like. When the user has finished consuming the mixture, the user may simply depress the nozzle 114 downwardly towards the outer collar 104 until the stem 142 has again entered the aperture 115 of the nozzle 114 to reseal the closure 100 and thus prevent or limit the mixture from exiting the closure 100. If desired, the user may again cover the nozzle 114 and at least a portion of the annular wall 110 with the cap 116. Of course, the user may subsequently remove the cap 116 and lift the nozzle 114 for subsequent consumption of the mixture as desired.

Numerous additions and modifications to the closure 100 are envisioned. For instance, portions of the closure that are to be grasped by users may have any appropriate gripping surfaces (e.g., gripping ribs, knurls, etc.). As another example, any appropriate safety wrapper (e.g., shrink wrap) may be applied over the cap 116 and body 102 before first use of the closure 100. Furthermore, it should be understood that the closure 100 may include plungers 124 other than the specific plunger 124 disclosed herein. For instance, some arrangements envision a plunger including only the shaft 170 and free of a specific rupture member (e.g., where the first end 174 of the shaft would essentially function as a rupture member; in this case, the shaft 170 may need to be constructed a bit longer than shown in the drawings), or a rupture member of a shape different than that shown herein. As another example, the second end 178 of the shaft 170 may in some arrangements have a widened portion that extends outward laterally of the sidewalls of the shaft to facilitate a user pressing downwardly directly on the second end 178 of the shaft to activate the closure 100 (i.e., as opposed to pressing downwardly on the cap 116). In one arrangement, the widened portion may be slightly concave to facilitate gripping of the widened portion by a user's finger. In any event, the diameter of such a widened portion may need to be slightly less than that of the aperture 115 of the nozzle 114 to allow the nozzle 114 to move into the open position as shown in FIG. 5.

Figure 6:
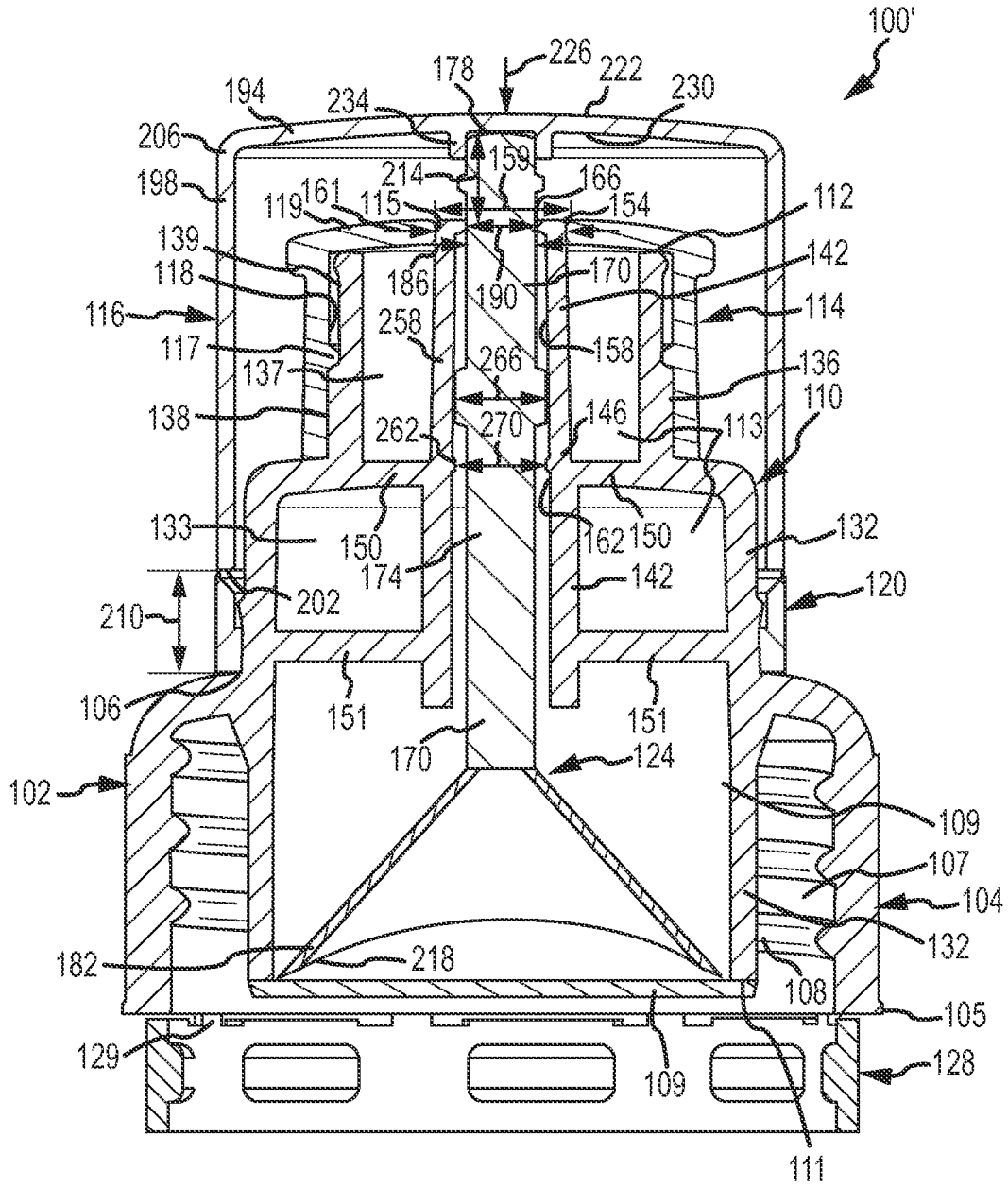
FIG. 6 is a sectional view of the container closure of FIG. 1 before a pull strip of the container closure has been removed, according to another embodiment.

In one arrangement, the first end 111 of the annular wall 110 may extend further into the interior cavity 107 of the outer collar 104, such as substantially to the first end 105 of the outer collar 104 as shown in the embodiment of the closure 100' shown in FIG. 6. This arrangement may advantageously increase the storage capacity of the storage compartment 113 as well as further provide for a more secure connection between the closure 100' and a container over which the closure 100' is secured (e.g., such as container 50 of FIG. 1).

In this arrangement, the shaft 170 of the plunger 124 may be increased in length (i.e., compared to its length in the embodiment of FIG. 3) to allow the rupture member 182 to still be able to rupture the seal 109 in the manner discussed previously. As shown, the increased length of the shaft 170 causes the free end 218 of the rupture member 182 to now be located substantially adjacent the first end 105 of the outer collar 104. In one variation, the stem 142 may be increased in length so as to extend into the first sub-compartment 133 and thereby serve to stabilize the longer shaft 170 of the plunger 124. Furthermore, one or more ribs 151 (e.g., similar to ribs 150) may be secured between the shaft 170 and the first portion 132 of the annular wall 110 to stabilize and rigidify the stem 142. As with the ribs 150, the ribs 151 may have a plurality of passageways (not shown) therebetween to allow for fluid passages therethrough.

Also disclosed herein is a method of filling one or more container closures with ingredients (e.g., supplements, vitamins, effervescent, etc.) of any appropriate form (e.g., powders, flakes, beads, capsules, liquids, etc.) for subsequent application or attachment to a container and eventual mixing between the ingredients and liquid in the container. While the method will be discussed in the context of filling the storage compartments 113 of the closures 100 disclosed herein, it is envisioned that the below disclosed filling method can be used to fill the storage compartments of various other container closures. Thus, it should be understood that the disclosed filling method is not to be limited to use with the closures 100 disclosed herein.

Figure 8:
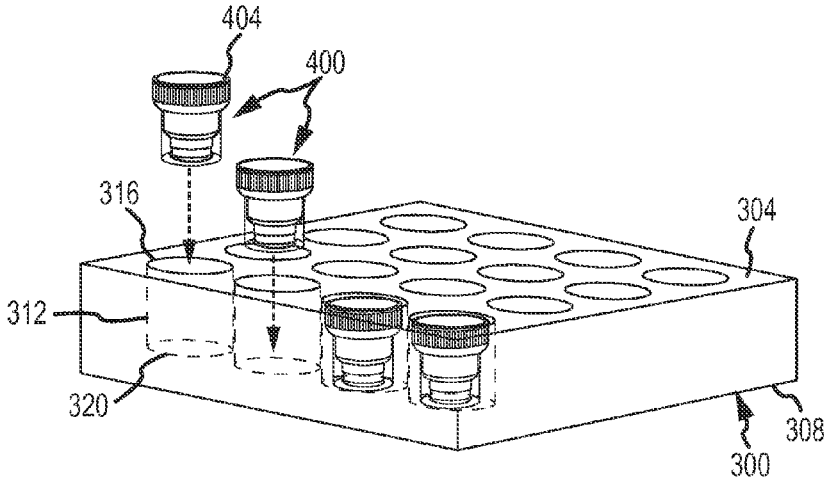
Figure 9:
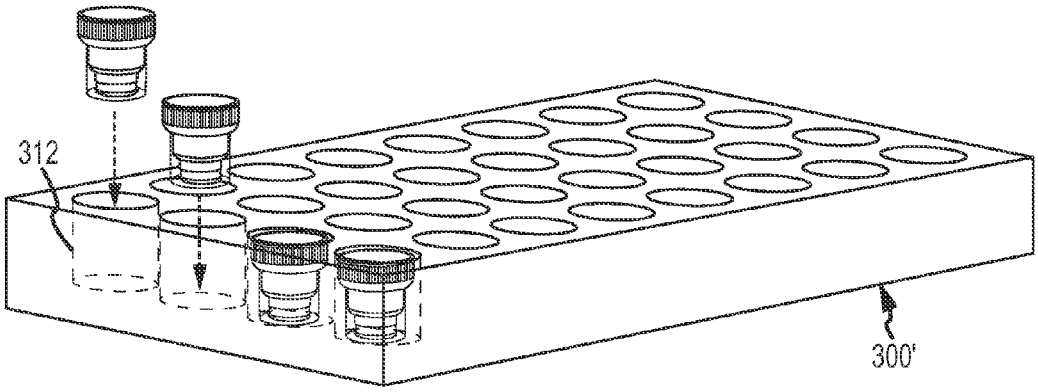

Turning initially to FIG. 8, the disclosed filling method may include use of a filling tray 300 (e.g., platform, base, container, etc.) generally including opposed upper and lower surfaces 304 along with a plurality of cavities 312 each extending from an opening 316 adjacent the upper surface 304 to a base 320. Initially, a plurality of container closures 400 (e.g., container closures 100) may be inserted into or otherwise loaded into the cavities 312 in a manner so that an opening 404 (e.g., interior cavity 107) leading to a storage compartment (e.g., storage compartment 113) of the closures 400 are facing upward or otherwise away from the base 312 (e.g., the closures 400 may be inserted upside down). Each cavity 312 may be generally sized and shaped to receive a closure 400 such that the closure 400 is generally restricted from moving laterally (e.g., side to side) while received in the cavity 312. In one arrangement, each cavity 312 may be stepped so as to more snuggly or securely receive and outer collar 104, lower portion 133 and upper portion 137 of a closure 100. The filling tray 300 may include any appropriate number of cavities 312. For instance, the filling tray 300 is shown with a 4×4 matrix of sixteen cavities 312. FIG. 9 illustrates another embodiment of a filing tray 300' including a 4×8 matrix of 32 cavities 312. The filling trays 300, 300' may be constructed of any appropriate material(s) such as rubber, metals, plastics, fiberglass, wood, alloys, composites, etc. and may have any appropriate dimensions.

Figure 10:
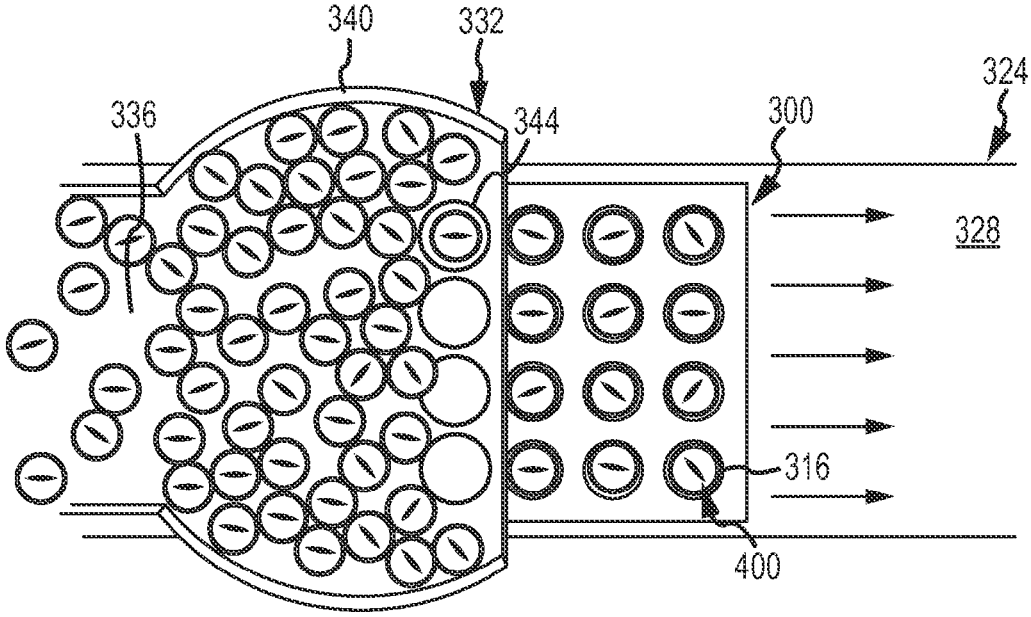
FIG. 10 is a plan view of platform that may be used to gravity feed container closures into the filling tray of FIGS. 8 and/or 9 as the filling tray moves along a conveyor belt.
Figure 11:
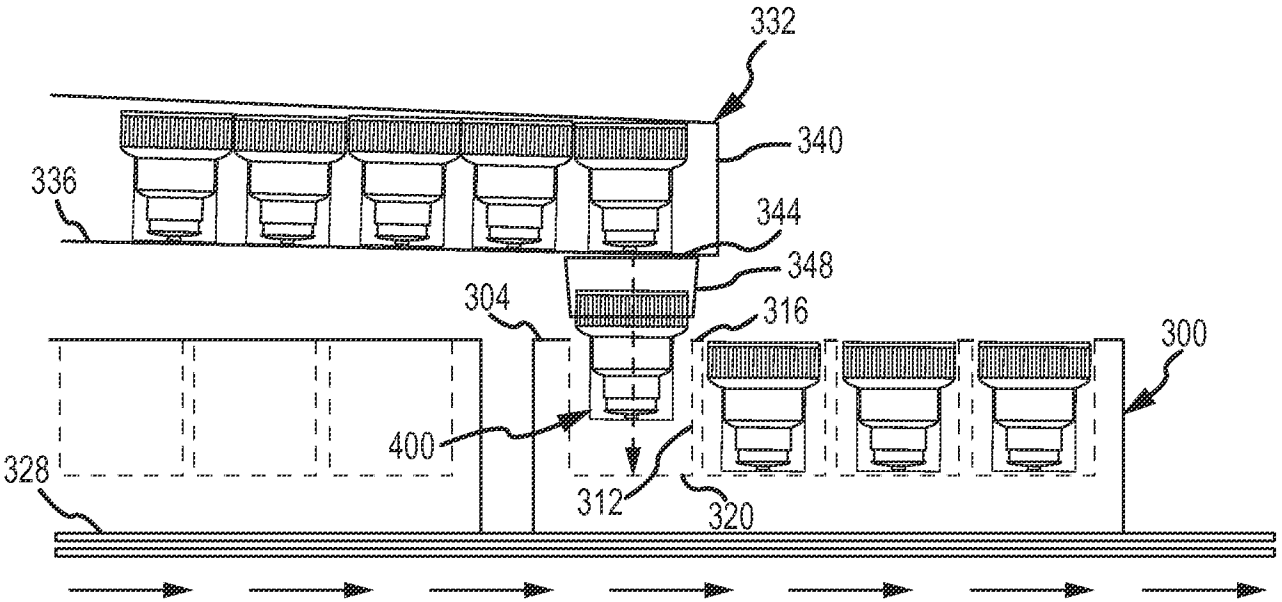
FIG. 11 is a side view of the platform of FIG. 8.

In one arrangement, the closures 400 may be manually inserted into the cavities 312. In another arrangement, the closures 400 may be inserted into the cavities 312 as part of any appropriate automated process. For instance, and turning now to FIGS. 10-11, the closures 400 may be appropriately gravity fed into the cavities 312. In one arrangement, the disclosed filling method may include use of a conveyor belt 324 having an upper surface 328 on which the lower surface 308 of the filling tray 300 may be received (e.g., removably secured to, substantially restricted from at least lateral movement, etc., in any appropriate manner) as well as a feeding platform 332 (e.g., holding bin or ring) spaced above the conveyor belt 324 and configured to gravity feed the closures 300 into the cavities 312 of the filling tray 300 via the respective openings 316. For instance, the feeding platform 332 may include a lower surface 336 that is adapted to receive the closures 400 in an upside down manner (i.e., so that the openings 404 are facing away from the lower surface 336) along with one or more upstanding sidewalls 340 that are adapted to contain the closures 400 on the feeding platform 332.

The feeding platform 332 may also include a plurality of apertures 344 extending completely through the lower surface 336 and that are sized to allow a closure 400 to fall therethrough (e.g., each aperture 344 may have a diameter that is slightly larger than a widest outer diameter of a closure 400). The apertures 344 may be formed and spaced so as to align with the openings 316 of filling trays 300 moving underneath the apertures 340 on the conveyor belt 324.

The closures 400 may be urged towards the apertures 344 in any appropriate manner. In one arrangement, the lower surface 336 of the feeding platform 332 may be angled relative to a filling tray 300 passing underneath the feeding platform 332 so that the closures 300 may slide under the force of gravity towards the apertures 344 and subsequently fall through the apertures 344 into corresponding cavities 312 of a filling tray 300 via their openings 316. See FIGS. 10-11. For instance, the lower surface 336 of the feeding platform 332 may be angled relative to the upper surface 304 of the filling trays 300 to any appropriate degree to cause sufficient feeding of the closures 300 towards the apertures 344 and eventually through the apertures 344 into the cavities 312 of a filling tray 300. In another arrangement, another conveyor belt (not shown) may urge the closures 400 towards the apertures 344. In a further arrangement, any appropriate rotating platform may be used to urge or pass closures 400 through a gate or the like towards the apertures 344. Other arrangements to urge or otherwise automatically insert or drop the closures 400 into the cavities 312 of the filling trays 300 are also envisioned and encompassed herein.

Figure 12:
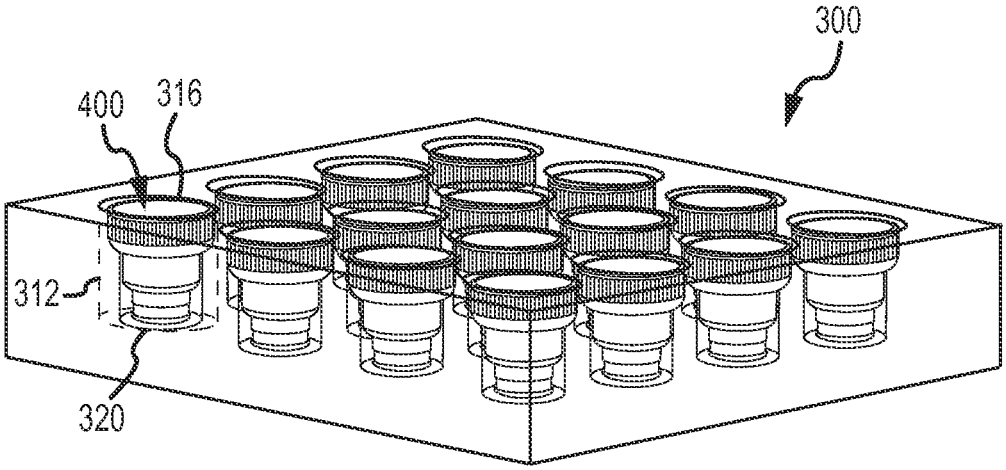
FIG. 12 is an isometric view of the filling tray of FIG. 8 loaded with a plurality of container closures.

Still further, any appropriately shaped members such as hollow, upside-down, frusto-conical members or sleeves 348 may be connected to an underside of the lower surface 336 of each of the apertures 344 so as to more accurately center the closures 400 over and into corresponding cavities 312 of the filling tray 300. In this variation, a closure 400 may be able to relatively easily fall into a particular aperture 344 in a manner that may not be, at least initially, directly centered over a particular opening 316 in the filling tray 300. However, the sleeves 348 may then serve to more accurately drop the closures 400 through the openings 316 and thus into the cavities 312. In any event, FIG. 12 illustrates the filling tray 300 being fully loaded with closures 400 in the cavities 312. In one arrangement, the cavities 312 of the filling trays 300 may be pre-loaded with caps (e.g., caps 116) in any appropriate manner (e.g., manually, in an automated manner, etc.) such that the nozzles and annular walls of the closures 400 may be inserted into the pre-loaded caps.

Figure 13:
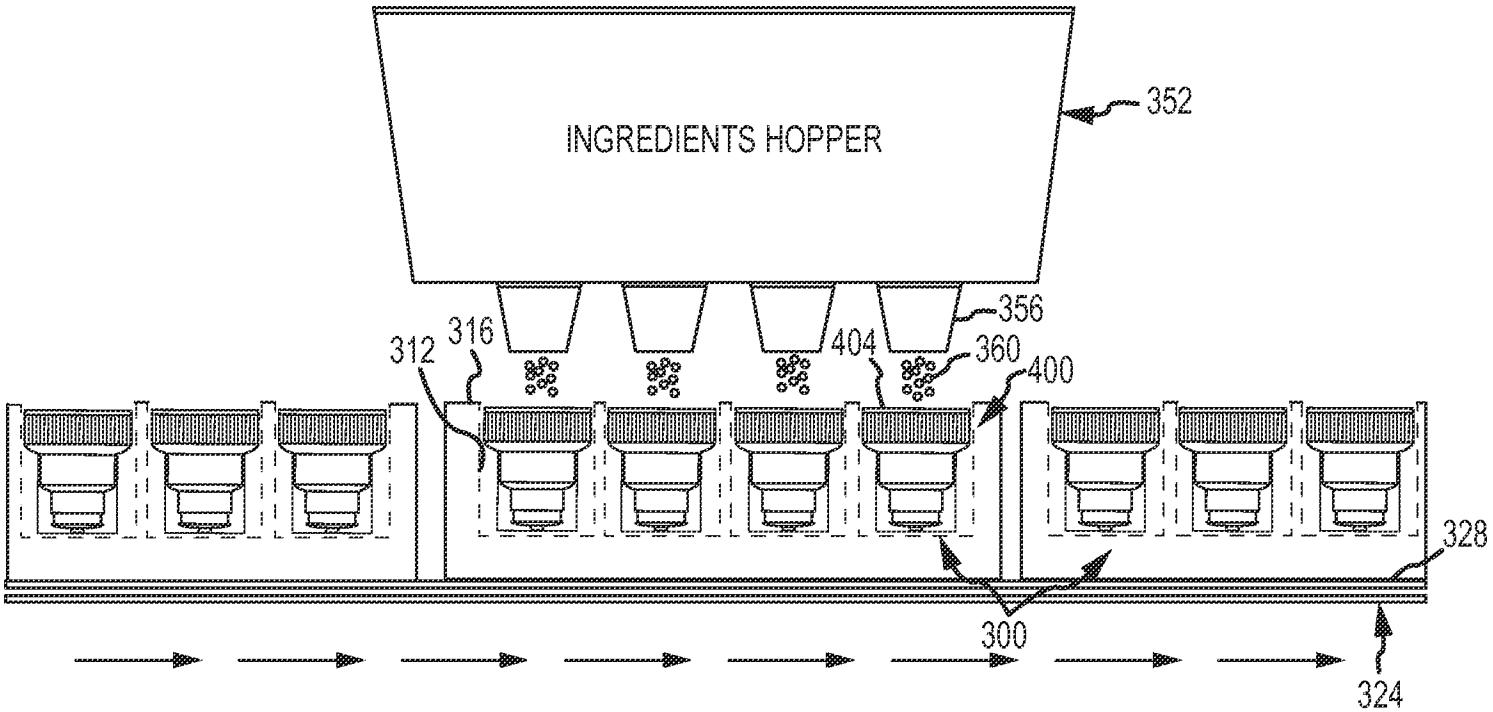
FIG. 13 is a side view of a number of the loaded filling trays of FIG. 12 moving past an ingredients hopper on the conveyor belt and receiving ingredients in storage compartments of the container closures.

Once the filling trays 300 has been loaded with closures 400 in one or more of the manners discussed above, the filling trays 300 may be appropriately moved on the conveyor belt 324 (or manually) past, underneath and/or through a number of stations. For instance, FIG. 13 shows the loaded filling trays 300 being moved via the conveyor belt 324 underneath an ingredients hopper 352 storing one or more ingredients in any appropriate form (e.g., beads, flakes, etc.). The hopper 352 may include a plurality of funnels or sleeves 356 or other filling devices that are configured to be respectively aligned over the openings 404 of incoming closures 400 and that are sized to deposit any appropriate volume of ingredients 360 into the storage compartments (not shown) of the closures 400 via the openings 404. In other arrangements, the closures 400 may be filled with the ingredients 360 manually (e.g., by hand). If necessary, the closures 400 may be appropriately shaken to induce any necessary settling of the ingredients 360 within the closures 400.

Figure 14:
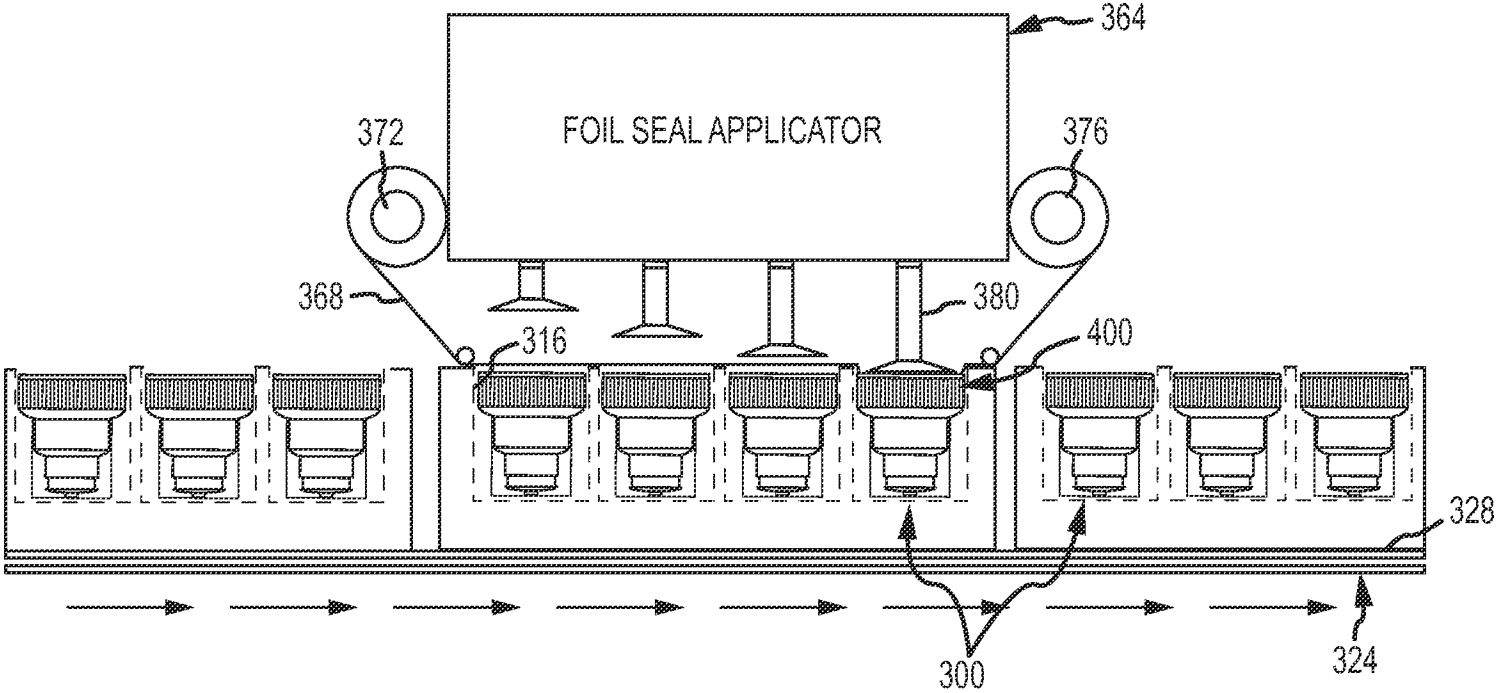
FIG. 14 is a side view of the loaded filling trays of FIG. 13 moving past a seal applicator on the conveyor belt and receiving seals over the storage compartments of the container closures to contain the ingredients therein.

After the closures 400 have been filled with ingredients, the filling trays 300 may be moved via the conveyor belt 424 underneath a seal applicator 364. See FIG. 14. For instance, the seal applicator 364 may include a length of foil 368 (or a length of any appropriate layer or sheet that may function as a seal, such as polymer seals) along with supply and take-up reels 372, 376 that are adapted to extend a continuous length of foil over all of the closures 400. The seal applicator 364 may also include a plurality of pistons 380 that are configured to be respectively aligned over the openings 316 (and thus the closures 400) and reciprocal towards and away from the closures 400 to press and cut a portion of the foil 368 onto one end of the storage compartment (e.g., onto first end 111 of annular wall 110 of closure 100 as shown in FIG. 3) so as to contain the ingredients 360 in the storage compartment (e.g., in storage compartment 113). As another example, the seals may be pre-cut such that each piston 380 serves to apply a pre-cut seal onto a respective closure 400. In some variations, the seals may become secured to the closures 400 upon contact via pressure sensitive adhesive or the like.

Figure 15:
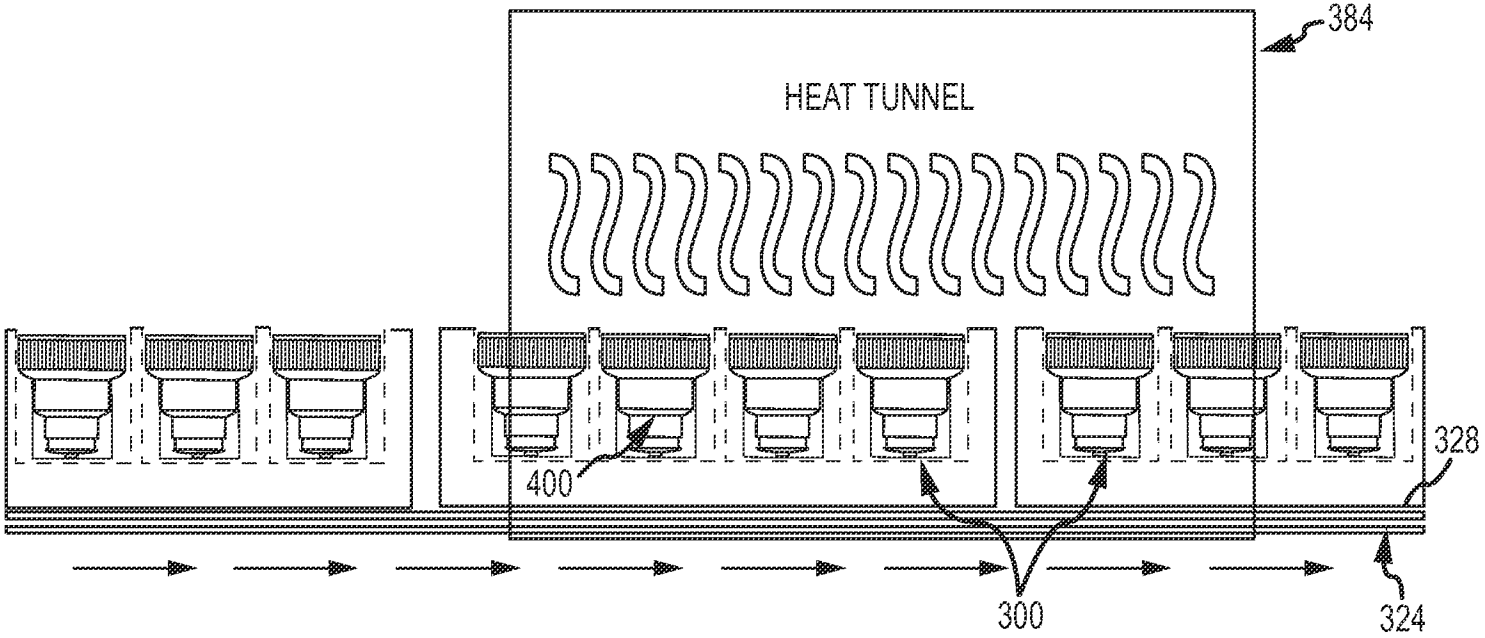
FIG. 15 is side view of the loaded filling trays of FIG. 14 moving past a heater on the conveyor belt and to seal the seals onto the storage compartments of the container closures and seal the ingredients therein.

In some arrangements, the filling trays 300 may then be moved through a heat tunnel 384 or other heating arrangement that is adapted to heat seal the foil portions applied via the seal applicator 364 onto the closures 400 so as to fully seal the ingredients 360 within the storage compartments of the closures 400. See FIG. 15. The filling trays 300 may be eventually moved past a packaging station whereby the filled and sealed closures 400 may be transferred to any appropriate packaging 388 (e.g., boxes, trays, pallets, bins, etc.) for shipment or transport to a bottling facility, retailers, end users, etc.

Figure 16:
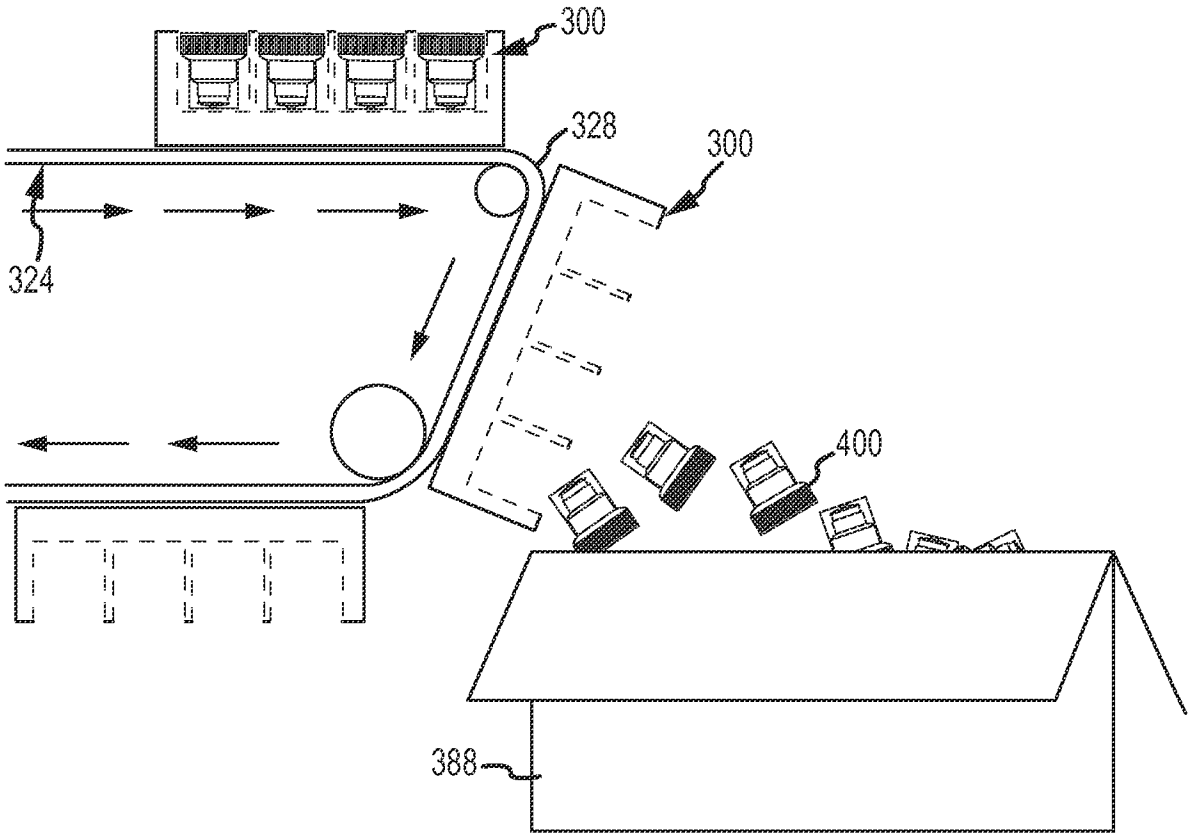
FIG. 16 is a side view of the loaded filling trays of FIG. 15 being transported into packaging.

For instance, the conveyor belt 324 may be configured to dump the filled and sealed closures 400 from the filling trays 300 into the packaging 388 as shown in FIG. 16. Before packaging the closures 400, the closures 400 may be inspected in any appropriate manner to check for defects and/or may be entirely wrapped in another plastic safety film or wrap. In one arrangement, the disclosed method comports with any required good manufacturing practices (GMP), sport certified (e.g., NSF) guidelines, over-the-counter (OTC) guidelines, and/or pharmaceutical guidelines. In any event, after the closures 400 have been removed from the filling trays 300, the filling trays 300 may remain on the conveyor belt 324 (e.g., in the case where the filling trays 300 are at least removably secured to the conveyor belt 324) whereby the conveyor belt 324 may eventually return the empty filling trays 300 to again be loaded with un-filled closures 400.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention.

While this disclosure contains many specifics, these should not be construed as limitations on the scope of the disclosure or of what may be claimed, but rather as descriptions of features specific to particular embodiments of the disclosure. Certain features that are described in this specification in the context of separate embodiments and/or arrangements can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A closure adapted to attach over an opening of a container, the container closure comprising:

a body comprising an outer collar configured to be secured to a finish of the container, and an annular wall extending away from the outer collar, wherein at least a portion of the annular wall surrounds a storage compartment;

a nozzle received on the annular wall, wherein the nozzle comprises an opening;

a cap receivable over a portion of the annular wall and the nozzle, the cap having first and second opposing ends;

an annular pull strip surrounding the annular wall and spacing the first end of the cover from the outer collar; and a plunger disposed within the storage compartment, wherein the pull strip prevents movement of the plunger towards the outer collar when the pull strip is spaced between the cap and the outer collar around the annular wall, and wherein at least partial separation of the pull strip from the annular wall allows movement of the plunger towards the outer collar.

2. The closure of claim 1, wherein pressing the second end of the cap towards the outer collar moves the plunger towards the outer collar after the pull tab has been at least partially separated from the annular wall.

3. The closure of claim 2, further comprising a first distance between the first end of the cap and the outer collar before the cap has been pressed towards the outer collar, and a second distance between the first end of the cap and the outer collar after the cap has been pressed towards the outer collar, wherein the first distance is greater than the second distance.

4. The closure of claim 1, further comprising:

a seal configured to seal a lower end of the storage compartment and prevent mixing between one or more ingredients disposed within the storage compartment and liquid in a container when the container closure is attached to the container, wherein the plunger is configured to at least partially break the seal and allow for mixing of the one or more ingredients and the liquid to create a mixture when the pull strip is at least partially separated from the annular wall and the plunger is moved towards the outer collar.

5. The closure of claim 4, wherein the second end of the cap contacts the plunger before breaking the seal.

6. The closure of claim 4, wherein the nozzle is moveable between at least a closed position sealing the storage compartment adjacent the second end of the annular wall and an open position unsealing the storage compartment adjacent the second end of the annular wall and allowing the mixture to exit the nozzle opening via the storage compartment.

7. The closure of claim 1, further comprising:

a hollow stem disposed within the storage compartment that receives the plunger.

8. The closure of claim 7, wherein the plunger comprises a first engagement member, wherein the hollow stem comprises a second engagement member, and wherein the first engagement member is adapted to engage with the second engagement member to prevent movement of the plunger relative to the stem once the second end of the cover has been pressed to break the seal with the plunger.

9. The closure of claim 8, wherein the first and second engagement members comprise ribs.

10. The closure of claim 9, wherein the first rib extends annularly around an outer surface of the plunger, and wherein the second rib extends annularly around an inner surface of the stem.

11. The closure of claim 1, wherein the annular wall comprises a first portion attached to the outer collar and a second portion spaced from the outer collar, wherein the first portion comprises a first outer diameter, wherein the second portion comprises a second outer diameter, and wherein the first outer diameter is greater than the second outer diameter.

12. A bottle, comprising:

a body;

a liquid contained within an internal cavity of the body;

an opening at one end of the body that leads into the internal cavity; and the closure of claim 4 secured over the bottle opening.

13. A closure adapted to attach over an opening of a container, the container closure comprising:

a body comprising an outer collar and an annular wall extending away from the outer collar, wherein the outer collar is configured to be secured to a finish of the container, and wherein at least a portion of the annular wall surrounds a storage compartment;

a hollow stem disposed within the storage compartment, the hollow stem comprising an interior cavity;

a nozzle received over an outer surface of the annular wall and comprising an aperture, wherein the nozzle is movable between at least a) a closed position in which the hollow stem is received in the nozzle aperture to limit the exit of fluids from the storage compartment via the nozzle aperture and b) an open position in which the hollow stem is spaced from the nozzle aperture to allow the exit of fluids from the storage compartment via the nozzle aperture; and a plunger disposed within the storage compartment and the interior cavity of the hollow stem, wherein the nozzle is movable relative to the plunger between the closed and open positions.

14. The closure of claim 13, wherein the nozzle is movable relative to the hollow stem between the closed and open positions.

15. The closure of claim 13, wherein the plunger comprises a first engagement member, wherein the hollow stem comprises a second engagement member, and wherein the first and second engagement members engage to limit movement of the plunger in a direction away from the outer collar.

16. An apparatus comprising:

a liquid container adapted to store a liquid and comprising a container opening; and a closure adapted to attach to the liquid container around the container opening, the container closure comprising:

a body comprising an outer collar and an annular wall extending away from the outer collar, wherein the annular wall surrounds a storage compartment;

a nozzle received on the annular wall, wherein the nozzle comprises an opening;

a cap received over the nozzle;

an annular pull strip surrounding the annular wall and spacing the cap from the outer collar;

a seal adapted to prevent mixing between a component contained in the storage compartment and liquid in the liquid container when the container closure is attached to the liquid container; and a plunger disposed inside of the storage compartment, wherein the plunger is prevented from breaking the seal when the pull tab is spaced between the cap and the outer collar around the annular wall, and wherein the plunger is allowed to break the seal when the pull tab is at least partially separated from the annular wall to thereby allow for mixing between the component and the liquid in the liquid container to create a mixture.

17. The apparatus of claim 16, wherein the component comprises at least one of a liquid, powder, pellets, flakes, effervescent, and beads.

* * * * *